US008210395B1

(12) United States Patent
Morris

(10) Patent No.: US 8,210,395 B1
(45) Date of Patent: Jul. 3, 2012

(54) SPRAY DISPENSER AND LIGHT EMITTING COMBINATION ASSEMBLY

(76) Inventor: Traci L. Morris, Washington, DC (US)

( * ) Notice: Subject to any disclaimer, the term of this patent is extended or adjusted under 35 U.S.C. 154(b) by 930 days.

(21) Appl. No.: 12/134,373

(22) Filed: Jun. 6, 2008

(51) Int. Cl.
*B65D 5/66* (2006.01)

(52) U.S. Cl. ..... 222/113; 222/321.7; 362/96

(58) Field of Classification Search ..... 222/113, 222/78, 321.7–321.9; 362/96, 384, 113; 446/475; 206/457
See application file for complete search history.

(56) References Cited

U.S. PATENT DOCUMENTS

| | | | | |
|---|---|---|---|---|
| 2,761,594 | A | 9/1956 | Stroh | |
| 3,006,510 | A | 10/1961 | Sagarin | |
| 4,291,839 | A | 9/1981 | Brett | |
| 4,434,914 | A * | 3/1984 | Meshberg | 222/153.11 |
| D295,834 | S | 5/1988 | Crapser | |
| 5,301,836 | A * | 4/1994 | Luu | 222/78 |
| D407,975 | S | 4/1999 | Lund et al. | |
| D424,939 | S | 5/2000 | Fan et al. | |
| 6,676,270 | B2 * | 1/2004 | Kostal et al. | 362/96 |
| 6,896,192 | B2 | 5/2005 | Horan et al. | |
| 6,938,795 | B2 * | 9/2005 | Barton et al. | 222/1 |
| D527,630 | S | 9/2006 | McConville et al. | |
| 7,475,794 | B2 * | 1/2009 | Walther et al. | 222/78 |
| 7,690,533 | B2 * | 4/2010 | Stilley | 222/113 |
| 2006/0223412 | A1 * | 10/2006 | Bobrowski | 446/267 |
| 2007/0189834 | A1 * | 8/2007 | McKay, Sr. | 401/123 |
| 2008/0000927 | A1 * | 1/2008 | Butler | 222/78 |
| 2009/0108034 | A1 * | 4/2009 | Bechyne et al. | 222/638 |
| 2010/0213212 | A1 * | 8/2010 | Custodis et al. | 222/113 |

FOREIGN PATENT DOCUMENTS

| | | | |
|---|---|---|---|
| DE | 29613250 | U1 * | 11/1996 |
| DE | 202006011208 | U1 * | 12/2006 |

OTHER PUBLICATIONS

English Translation of DE 202006011208.*
Partial translation of DE 29613250.*

* cited by examiner

*Primary Examiner* — Kevin P Shaver
*Assistant Examiner* — Robert Nichols, II

(57) ABSTRACT

A spray dispenser and light emitting combination assembly includes a fluid ejecting apparatus that includes a pump and an actuator that is fluidly coupled to the pump. An inlet tube is fluidly coupled to the pump and an outlet tube is fluidly coupled to the pump. The outlet tube has a free end defining a nozzle. The nozzle is positioned in the actuator. The actuator actuates the pump when the actuator is depressed to draw fluid into the inlet tube and eject the fluid outwardly of the nozzle. A container is threadably coupled to the fluid ejecting apparatus. The inlet tube extends into an interior of the container and the nozzle is positioned outside of the container. A light emitting apparatus is mounted in the fluid ejecting system and emits light when the actuator is depressed.

7 Claims, 5 Drawing Sheets

SPRAY DISPENSER AND LIGHT EMITTING COMBINATION ASSEMBLY

BACKGROUND OF THE INVENTION

Field of the Invention

The present invention relates to light emitting fluid spraying devices and more particularly pertains to a new light emitting fluid spraying device for indicating a direction of spray from a nozzle.

SUMMARY OF THE INVENTION

The present invention meets the needs presented above by generally comprising a fluid ejecting apparatus that includes a pump and an actuator that is fluidly coupled to the pump. An inlet tube is fluidly coupled to the pump and an outlet tube is fluidly coupled to the pump. The outlet tube has a free end defining a nozzle. The nozzle is positioned in the actuator. The actuator actuates the pump when the actuator is depressed to draw fluid into the inlet tube and eject the fluid outwardly of the nozzle. A container is threadably coupled to the fluid ejecting apparatus. The inlet tube extends into an interior of the container and the nozzle is positioned outside of the container. A light emitting apparatus is mounted in the fluid ejecting system and emits light when the actuator is depressed.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
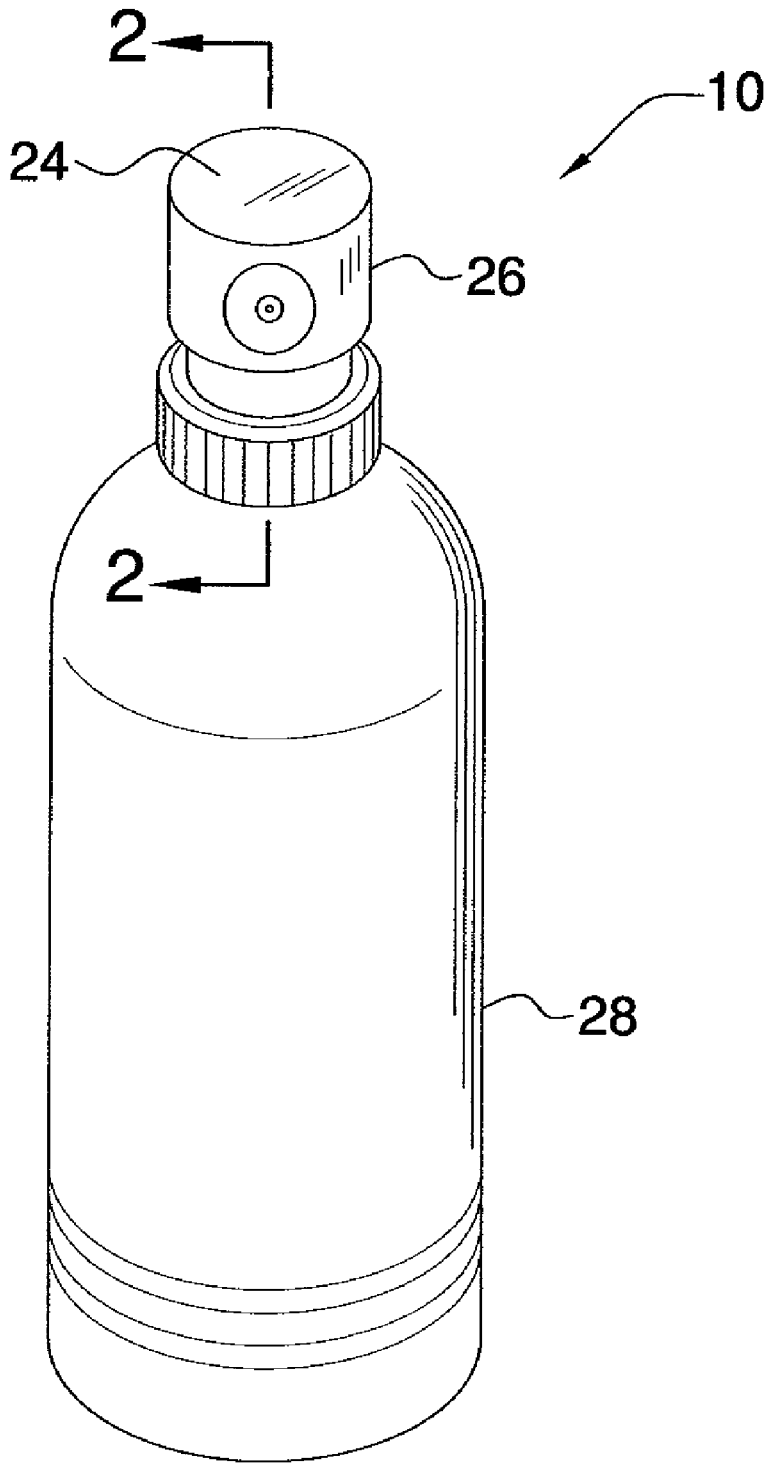
FIG. 1 is a front perspective view of a spray dispenser and light emitting combination assembly according to the present invention.
Figure 2:
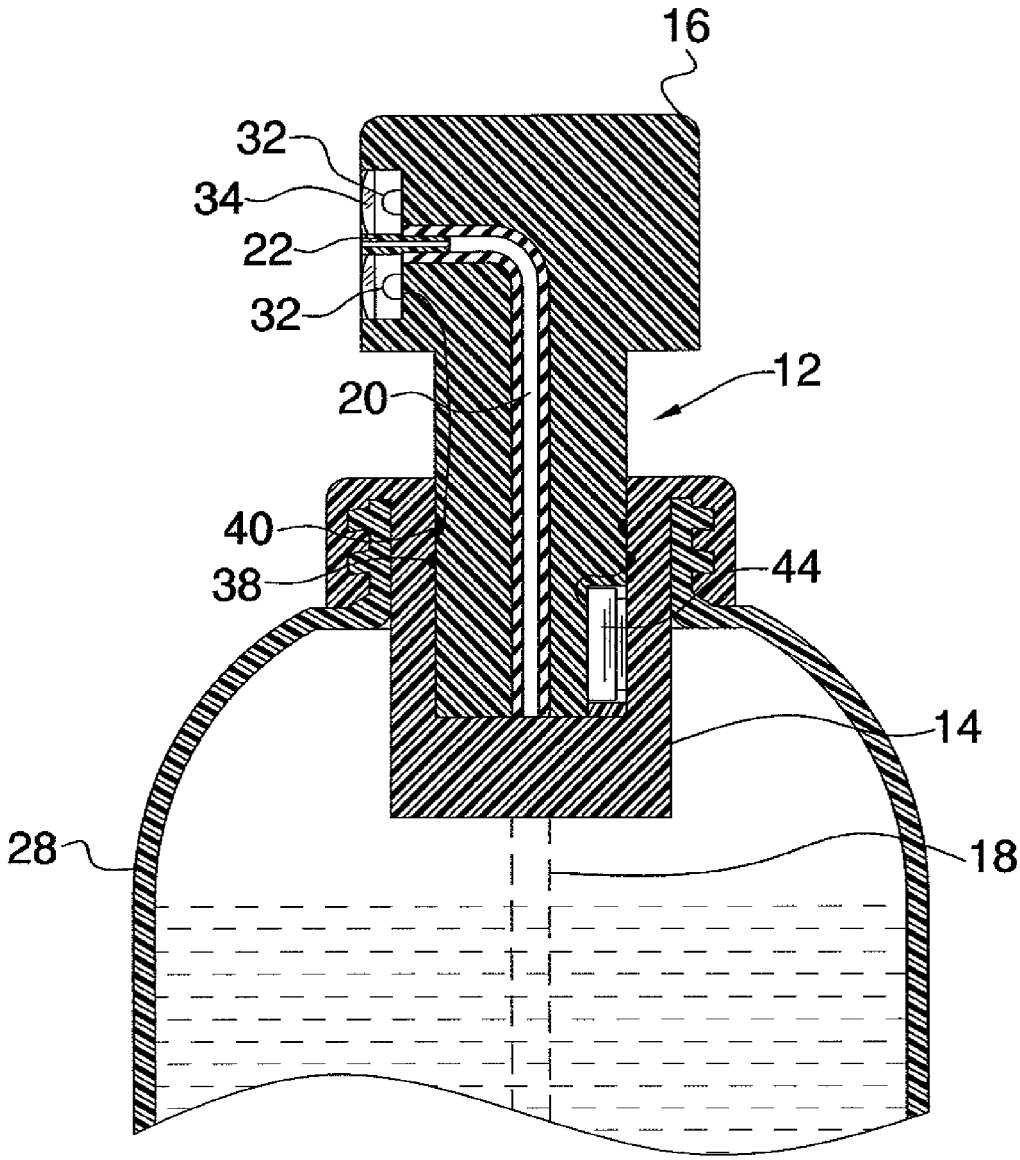
FIG. 2 is a cross-sectional view taken along line 2-2 of FIG. 1 of the present invention.
Figure 3:
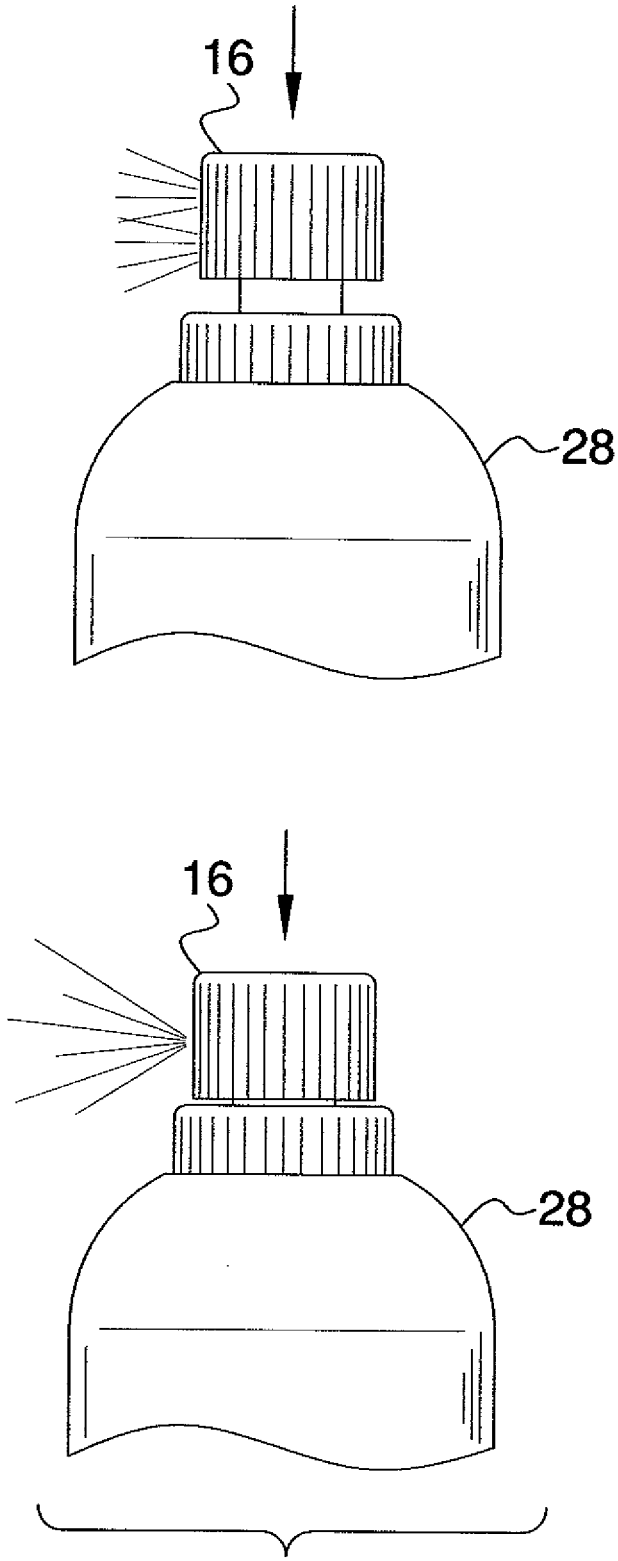
FIG. 3 is a side view of the present invention.

With reference now to the drawings, and in particular to FIGS. 1 through 5 thereof, a new light emitting fluid spraying device embodying the principles and concepts of the present invention and generally designated by the reference numeral 10 will be described.

As best illustrated in FIGS. 1 through 5, the spray dispenser and light emitting combination assembly 10 generally comprises a conventional fluid ejecting apparatus 12 that includes a pump 14 and an actuator 16 that is fluidly coupled to the pump 14. An inlet tube 18 is fluidly coupled to the pump 14 and an outlet tube 20 is fluidly coupled to the pump 14. The outlet tube 20 has a free end defining a nozzle 22 that is positioned in the actuator 16. The actuator 16 actuates the pump 14 when the actuator 16 is depressed and the pump 14 draws fluid into the inlet tube 18 and ejects the fluid outwardly of the nozzle 22 when the actuator 16 is actuated. The actuator 16 includes a top wall 24 and a perimeter wall 26 extending downwardly from the top wall 24. The nozzle 22 is mounted in the perimeter wall 26.

A container 28 is threadably coupled to the fluid ejecting apparatus 12. The inlet tube 18 extends into an interior of the container 28. The nozzle 22 is positioned outside of the container 28. The fluid ejected by the nozzle 22 is positioned in the container 28 and may include any conventional fluid typically dispensed by hand actuated sprayers such as personal fragrance.

Figure 4:
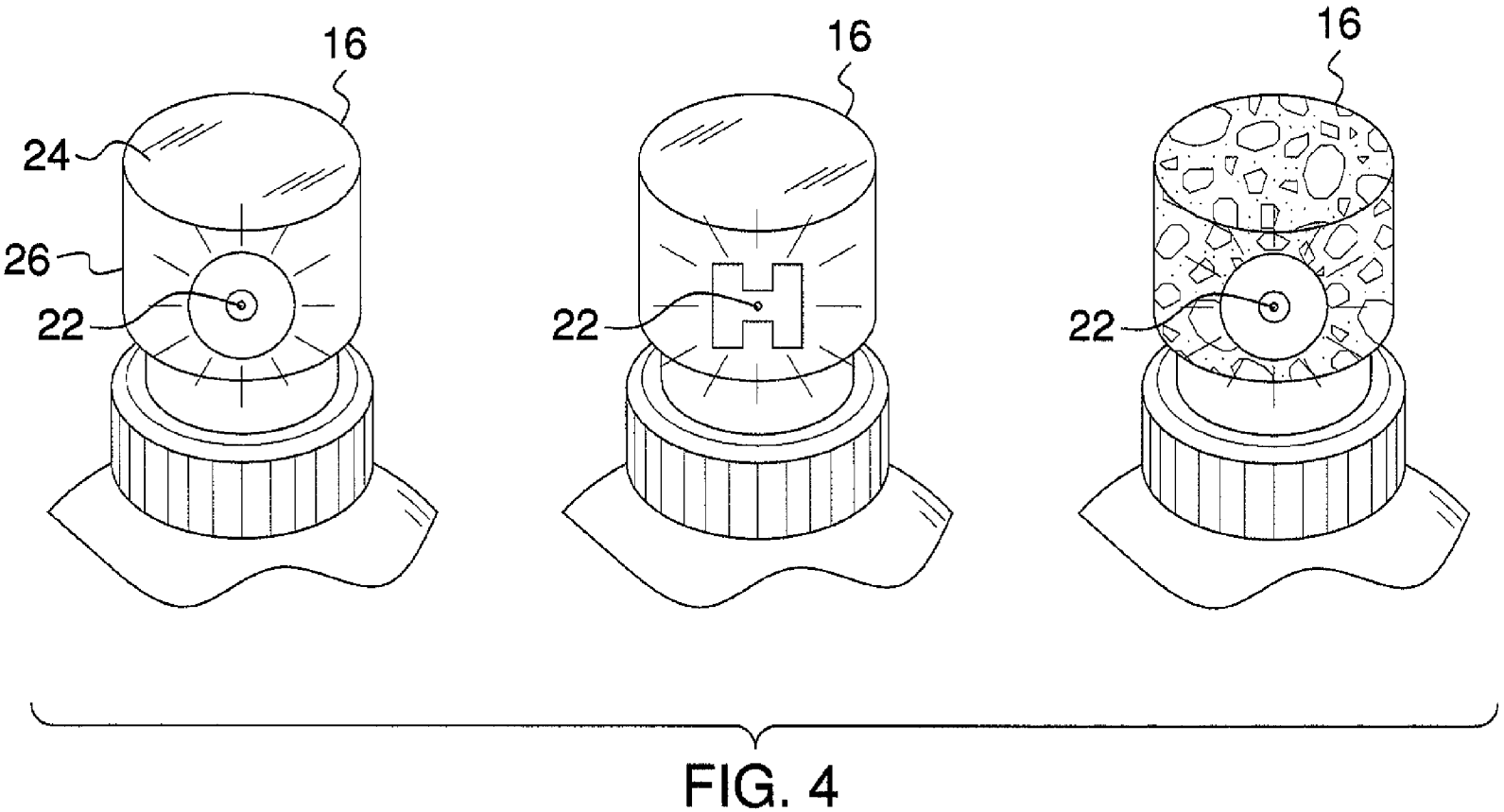
FIG. 4 is a front perspective view of a plurality of embodiments of the present invention.
Figure 5:
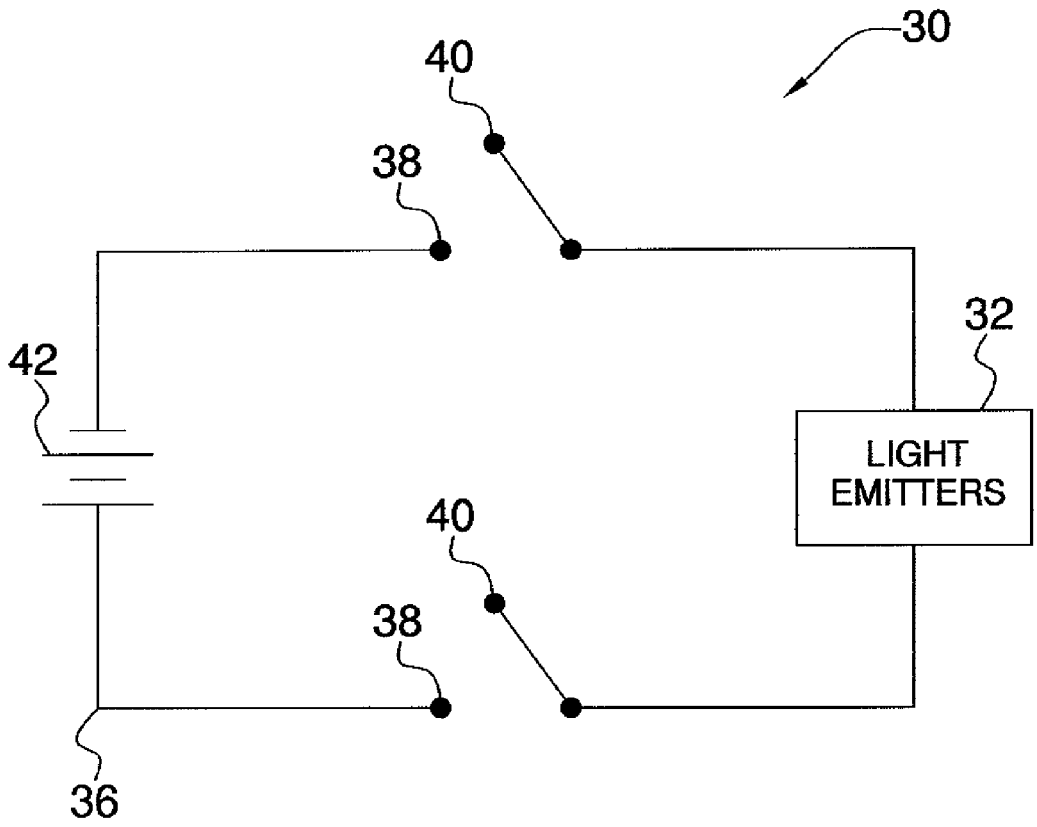
FIG. 5 is a schematic view of the present invention.

A light emitting apparatus 30 is mounted in the fluid ejecting system 12 and emits light when the actuator 16 is depressed. The light emitting apparatus 30 includes a plurality of light emitters 32 mounted on the actuator 16. The light emitters 32 emit light in a same direction as fluid ejected by the nozzle 22 when the light emitters 32 are turned on. The light emitters 32 are mounted in a depression in the perimeter wall 26 of the actuator 16 and adjacent to the nozzle 22. The light emitters 32 are positioned in a pattern extending around the nozzle 22. The pattern may simply be a circle or a symbol as shown in FIG. 4. The light emitters 32 may be covered by a transparent covering 34 to protect them. The light emitters 32 are typically light emitting diodes which are not intended to illuminate an area to be sprayed by the nozzle 22 but help a person to quickly find where the nozzle 22 is so that they can be assured of knowing what direction the nozzle 22 will spray the fluid.

The light emitting apparatus 30 further includes a circuit 36 that has a first connection 38 and a second connection 40. The first connection 38 is mounted to the pump 14 and the second connection 40 is mounted to the actuator 16. The first 38 and second 40 connections abut and close the circuit 36 to turn on the light emitters 32 when the actuator 16 is depressed. Preferably, the circuit 36 is closed when the actuator 16 is partially depressed, as is shown in the upper portion of FIG. 3, and the pump 14 is actuated when the actuator 16 is fully depressed, as is shown in the lower portion of FIG. 3. In this way, the light emitters 32 will be illuminated before the fluid is actually ejected from the nozzle 22. Also, once the actuator 16 is moved from partially to fully depressed, the circuit 16 would be open and the light emitters 32 turned off. A power source 42 is electrically coupled to the first connection 38. The power source 42 may comprise a battery 44.

In use, the container 28 and fluid ejecting apparatus are used in a conventional manner to hold and to dispense a fluid, such as perfumes and the like. When a person wished to spray the fluid on themselves, they first partially depress the actuator 16 to locate the nozzle 22 to know which direction the fluid will come from and then properly aim the nozzle 22. The actuator 16 is then fully depressed to eject the fluid onto the person.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A spray dispensing assembly comprising:

a fluid ejecting apparatus including a pump and an actuator being fluidly coupled to said pump, an inlet tube being fluidly coupled to said pump and an outlet tube being fluidly coupled to said pump, said outlet tube having a free end defining a nozzle, said nozzle being positioned in said actuator, said actuator actuating said pump when said actuator is depressed, said pump drawing fluid into said inlet tube and ejecting the fluid outwardly of said nozzle when said actuator is actuated;

a container being threadably coupled to said fluid ejecting apparatus, said inlet tube extending into an interior of said container, said nozzle being positioned outside of said container;

a light emitting apparatus being mounted in said fluid ejecting apparatus and emitting light when said actuator is depressed, said light emitting apparatus being configured to indicate a direction of the fluid being sprayed outwardly from said fluid ejecting apparatus, said light emitting apparatus including;

at least one light emitter mounted on said actuator, said at least one light emitter emitting light in a same direction as fluid ejected by said nozzle when said at least one light emitter is turned on;

a circuit including a first connection and a second connection, said first connection being mounted to said pump and said second connection being mounted to said actuator, said first and second connections abutting and closing said circuit to turn on said light emitting apparatus when said actuator is depressed, said light emitting apparatus including at least one light emitter, said at least one light emitter includes a plurality of light emitters positioned in a pattern extending around said nozzle; and a power source being electrically coupled to said first connection.

2. The assembly according to claim 1, wherein said at least one light emitter is mounted in a depression in a perimeter wall of said actuator adjacent to said nozzle.

3. The assembly according to claim 1, wherein said circuit is closed when said actuator is partially depressed and said pump being actuated when said actuator is fully depressed.

4. A spray dispensing assembly comprising:

a fluid ejecting apparatus including a pump and an actuator being fluidly coupled to said pump, an inlet tube being fluidly coupled to said pump and an outlet tube being fluidly coupled to said pump, said outlet tube having a free end defining a nozzle, said nozzle being positioned in said actuator, said actuator actuating said pump when said actuator is depressed, said pump drawing fluid into said inlet tube and ejecting the fluid outwardly of said nozzle when said actuator is actuated, said actuator including a top wall and a perimeter wall extending downwardly from said top wall, said nozzle being mounted in said perimeter wall;

a container being threadably coupled to said fluid ejecting apparatus, said inlet tube extending into an interior of said container, said nozzle being positioned outside of said container;

a light emitting apparatus being mounted in said fluid ejecting apparatus and emitting light when said actuator is depressed, said light emitting apparatus indicating a direction of the fluid being sprayed outwardly from said fluid ejecting apparatus, said light emitting apparatus including;

a plurality of light emitters mounted on said actuator, said light emitters emitting light in a same direction as fluid ejected by said nozzle when said light emitters are turned on, said light emitters being mounted in a depression in said perimeter wall of said actuator adjacent to said nozzle, said light emitters being positioned in a pattern extending around said nozzle;

a circuit including a first connection and a second connection, said first connection being mounted to said pump and said second connection being mounted to said actuator, said first and second connections abutting and closing said circuit to turn on said light emitters when said actuator is depressed, said circuit being closed when said actuator is partially depressed and said pump being actuated when said actuator is fully depressed; and a power source being electrically coupled to said first connection, said power source comprising a battery.

5. A spray dispensing assembly comprising:

a fluid ejecting apparatus including a pump and an actuator being fluidly coupled to said pump, an inlet tube being fluidly coupled to said pump and an outlet tube being fluidly coupled to said pump, said outlet tube having a free end defining a nozzle, said nozzle being positioned in said actuator, said actuator actuating said pump when said actuator is depressed, said pump drawing fluid into said inlet tube and ejecting the fluid outwardly of said nozzle when said actuator is actuated;

a container being threadably coupled to said fluid ejecting apparatus, said inlet tube extending into an interior of said container, said nozzle being positioned outside of said container; and a light emitting apparatus being mounted in said fluid ejecting apparatus and emitting light when said actuator is depressed, said light emitting apparatus indicating a direction of the fluid being sprayed outwardly from said fluid ejecting apparatus, said light emitting apparatus including;

at least one light emitter mounted on said actuator, said at least one light emitter emitting light in a same direction as fluid ejected by said nozzle when said at least one light emitter is turned on;

a circuit including a first connection and a second connection, said first connection being mounted to said pump and said second connection being mounted to said actuator, said first and second connections abutting and closing said circuit to turn on said light emitting apparatus when said actuator is depressed, said light emitting apparatus including at least one light emitter, said at least one light emitter includes a plurality of light emitters positioned in a pattern extending around said nozzle; and a power source being electrically coupled to said first connection.

6. The assembly according to claim 5, wherein said at least one light emitter is mounted in a depression in a perimeter wall of said actuator adjacent to said nozzle.

7. The assembly according to claim 5, wherein said circuit is closed when said actuator is partially depressed and said pump being actuated when said actuator is fully depressed.

* * * * *